US009048036B2

(12) United States Patent
Kikuchi et al.

(10) Patent No.: US 9,048,036 B2
(45) Date of Patent: Jun. 2, 2015

(54) SWITCHING APPARATUS PROVIDED WITH SWITCHES AND LEVER

(75) Inventors: Yukihisa Kikuchi, Shizuoka (JP); Yuichi Motoshige, Shizuoka (JP); Nobuyuki Kawai, Tokyo (JP); Naoyuki Horii, Tokyo (JP); Ryoji Taneda, Tokyo (JP); Takehide Tone, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 189 days.

(21) Appl. No.: 13/820,200

(22) PCT Filed: Sep. 30, 2011

(86) PCT No.: PCT/JP2011/073158

§ 371 (c)(1),
(2), (4) Date: Mar. 1, 2013

(87) PCT Pub. No.: WO2012/043889

PCT Pub. Date: Apr. 5, 2012

(65) Prior Publication Data

US 2013/0161176 A1 Jun. 27, 2013

(30) Foreign Application Priority Data

Sep. 30, 2010 (JP) ..... 2010-220851

(51) Int. Cl.
*H01H 13/56* (2006.01)
*H01H 9/26* (2006.01)
(Continued)

(52) U.S. Cl.
CPC ..... *H01H 9/26* (2013.01); *H01H 21/04* (2013.01); *H01H 19/00* (2013.01)

(58) Field of Classification Search
CPC ..... H01H 9/26; H01H 21/04; H01H 19/00; H01R 13/62
USPC ..... 200/5 B; 439/157–159
See application file for complete search history.

(56) References Cited

U.S. PATENT DOCUMENTS 4,346,419 A 8/1982 Janniello
5,971,801 A * 10/1999 Kato et al. ..... 439/511
(Continued)

FOREIGN PATENT DOCUMENTS

CN 1701987 A 11/2005
JP S57-185683 A 11/1982
(Continued)

OTHER PUBLICATIONS

Japanese Office Action dated Sep. 2, 2014 for corresponding Japanese patent application No. 2010-220851.
(Continued)

*Primary Examiner* — Renee Luebke
*Assistant Examiner* — Ahmed Saeed
(74) *Attorney, Agent, or Firm* — Morgan, Lewis & Bockius LLP

(57) ABSTRACT

A switching apparatus includes a base, a housing, a main switch for mechanically disconnecting a power supply circuit and an interlock switch for electrically disconnecting the power supply circuit. The switching apparatus also includes a lever which is rotatably supported by one of the base and the housing and also is engaged with an engaging section formed in the other of the base and the housing. The lever causes a wall of the housing to be slid in a depth direction of an annular groove of the base in accordance with a rotation of the lever. The interlock switch is disconnected ahead of the main switch by separating a movable terminal of the interlock switch away from a fixed terminal of the interlock switch when the lever is rotated to cause the housing slid in a direction away from the base.

5 Claims, 4 Drawing Sheets

(51) Int. Cl.
*H01H 21/04* (2006.01)
*H01H 19/00* (2006.01)

(56) References Cited

U.S. PATENT DOCUMENTS

| | | | | |
|---|---|---|---|---|
| 7,815,448 | B2 | 10/2010 | Kawai et al. | |
| 7,973,253 | B2 | 7/2011 | Gibbs et al. | |
| 2003/0057958 | A1 | 3/2003 | Fukushima et al. | |
| 2003/0087542 | A1 | 5/2003 | Yamakawa et al. | |
| 2005/0266740 | A1 | 12/2005 | Kikuchi et al. | |
| 2008/0185276 | A1* | 8/2008 | Matsunaga et al. | 200/335 |
| 2009/0197456 | A1 | 8/2009 | Kawai et al. | |
| 2010/0140061 | A1 | 6/2010 | Gibbs et al. | |

FOREIGN PATENT DOCUMENTS

| | | | |
|---|---|---|---|
| JP | H06-002946 | A | 1/1994 |
| JP | 2003-100386 | A | 4/2003 |
| JP | 2003-141973 | A | 5/2003 |
| JP | 2004-039283 | A | 2/2004 |
| JP | 2008-198358 | | 8/2008 |
| JP | 2009-181895 | | 8/2009 |
| WO | 2006/109892 | | 10/2006 |

OTHER PUBLICATIONS

International Search Report dated Jan. 18, 2012 for International application No. PCT/JP2011/073158.

Written Opinion of the International Searching Authority for International application No. PCT/JP2011/073158, Aug. 25, 2014.

Chinese Office Action issued in Chinese Patent Application No. 201180047783.3 on Oct. 28, 2014.

* cited by examiner

SWITCHING APPARATUS PROVIDED WITH SWITCHES AND LEVER

TECHNICAL FIELD

The present invention relates to a switching apparatus, and particularly to a switching apparatus including a mechanical main switch for disconnecting a power supply circuit, and an interlock switch for outputting a disconnection signal to the outside before this main switch is disconnected.

BACKGROUND ART

A vehicle such as an electric vehicle is equipped with a DC power source such as a battery or a fuel cell as a power source for driving a load of a motor etc., and the DC power source is connected to the load through a power supply circuit. Accordingly, the vehicle such as an electric vehicle is provided with a switching apparatus for manually disconnecting a connection to the power supply circuit in order to prevent an electric shock in the case of maintenance work of the load, and the like.

As this kind of switching apparatus, for example, there is disclosed a switching apparatus including a base, a housing having a wall inserted into an annular groove of a surface of the base, a fixed terminal fixed to the base and a movable terminal fixed to the housing, in which the housing is slid in a direction away from the base along the annular groove of the base by a rotating operation of a lever and thereby the movable terminal is separated from the fixed terminal and a power supply circuit is disconnected (for example, see Patent Literature 1).

When a power supply circuit through which a current flows is disconnected by a switching apparatus, sparks occur between terminals. When the sparks occur thus, the terminals etc. may be degraded in addition to affecting a signal system as noise. Hence, a switching apparatus including a mechanical main switch disconnected by an operation of a worker and an interlock switch (a limiter switch) for outputting a disconnection signal of the power supply circuit to an external disconnecting unit before the main switch is disconnected has been disclosed (for example, see Patent Literature 2).

According to the switching apparatus disclosed in Patent Literature 2, by disconnecting the interlock switch before the main switch is disconnected, the disconnection signal is outputted to an external relay, etc. and the power supply circuit becomes disconnected, so that occurrence of sparks at the time of disconnecting the main switch can be prevented.

CITATION LIST

Patent Literature

Patent Literature 1: JP-A-2009-181895
Patent Literature 2: JP-A-2008-198358

SUMMARY OF INVENTION

Technical Problem

However, in Patent Literature 2, when the worker intends to open the main switch, a rotational lock plate is first rotated with the worker's finger to be unlocked, and then a service plug is pulled out of the inside of a case. The interlock switch is disconnected by unlocking the rotational lock plate. That is, according to the configuration disclosed in Patent Literature 2, two operations of unlocking the rotational lock plate and pulling the service plug out are required in the case of interrupting the power supply circuit. Thus, the operations become complicated and also the apparatus configuration becomes complex.

Also, in Patent Literature 2, since the interlock switch is provided in the outside of the case, when a waterproof switching apparatus is to be designed, the interlock switch must be covered with a waterproof cover etc. and there are problems that installation space of the switching apparatus increases and the cost of the apparatus increases.

An object of the invention is to provide a switching apparatus capable of facilitating a disconnecting operation, achieving miniaturization and further preventing occurrence of sparks at the time of disconnection and connection.

Solution to Problem

According to an aspect of the invention, there is provided a switching apparatus including: a main switch for mechanically disconnecting a power supply circuit; an interlock switch which outputs a disconnection signal to an external for electrically disconnecting the power supply circuit; a base on which an annular groove is formed; a housing having a wall to be inserted into the annular groove of the base; and a lever which is rotatably supported by one of the base and the housing and also is engaged with an engaging section formed in the other of the base and the housing, the lever causing the wall of the housing to be slid in a depth direction of the annular groove in accordance with a rotation of the lever, wherein each of the main switch and the interlock switch includes a fixed terminal fixed to the base and a movable terminal fixed to the housing, and the interlock switch is configured to be disconnected ahead of the main switch by separating the movable terminal of the interlock switch away from the fixed terminal of the interlock switch when the lever is rotated to cause the housing slid in a direction away from the base.

According to the aspect of the invention, the movable terminals of the main switch and the interlock switch move integrally with the housing, so that the movable terminals are respectively separated from the fixed terminals by moving the housing in the direction away from the base. Here, the housing can be moved by an operation of the lever, so that the power is supply circuit can be disconnected by a simple operation using only the lever. Also, both of the interlock switch and the main switch are arranged inside the housing and the housing normally becomes fitted into the base, so that waterproof and dustproof properties can be increased with a simple and compact configuration. Also, when the main switch is disconnected, the interlock switch has already been disconnected and in response to this, for example, electromagnetic switchgear or the like provided in the DC power source side is opened and the power supply circuit is disconnected, so that occurrence of sparks at the time of disconnecting the main switch can be prevented. Moreover, when the main switch is connected, the interlock switch is not connected yet, so that occurrence of sparks at the time of connecting the main switch can be prevented.

The switching apparatus may be configured so that the fixed terminals of the main switch and the interlock switch include female terminals, the movable terminals of the main switch and the interlock switch include male terminals to be inserted into the respective female terminals, and when the lever is rotated to cause the housing slid in the direction away from the base and reaches a maximum rotation angle of the lever, a part of the male terminal of the main switch is still being inserted in the opposing female terminal.

According to the configuration, when the lever is rotated, it is unnecessary to consider disconnection of the main switch and the housing has only to be moved to a position in which the interlock switch is disconnected, so that a dimension of a height direction of the switching apparatus, that is, a movement direction of the housing can be decreased. Even for such a configuration, at a point in time when the lever reaches the maximum rotation angle, the interlock switch is disconnected and the power supply circuit is electrically disconnected, so that sparks do not occur even when the housing is thereafter detached from the base and the main switch is disconnected. Moreover, in a state in which the lever is at the maximum rotation angle (an initial state), even when the housing is attached to the base and the main switch becomes connected, the interlock switch is not connected and thereafter, the lever is rotated and the housing further moves toward the base and thereby, the interlock switch is connected. That is, after the main switch is connected, the interlock switch is connected and the power supply circuit becomes closed and thereby the main switch conducts, so that occurrence of sparks in the main switch can be prevented. Consequently, the main switch also plays a role as a guide of the interlock switch, so that accuracy of positioning between the male terminal and the female terminal of the interlock switch is improved and damage to the terminals or the like in the case of inserting the male terminal into the female terminal can be prevented.

The switching apparatus may be configured so that the movable terminal of the main switch includes two male terminals each formed in a flat plate, the fixed terminal of the main switch includes two female terminals to be inserted into the two female terminals, respectively, and the two male terminals are arranged substantially perpendicularly to each other.

Further, the two male terminals may be separated away from each other.

According to the configuration, alignment between the male terminals and the female terminals in the main switch is facilitated and also a role as a guide of the interlock switch is played, so that accuracy of positioning between the male terminals and the female terminals of both the switches is improved and damage to the terminals or the like can be prevented.

The switching apparatus may be configured so that the lever includes a lock hole, the base includes a protrusion to be engaged with the lock hole to thereby regulate the rotation of the lever, and in accordance with the rotation of the lever, the interlock switch is connected when the protrusion is engaged with the lock hole, whereas the interlock switch is disconnected when the protrusion is disengaged from the lock hole.

According to the configuration, a halfway connection state in which the interlock switch is connected before the protrusion is engaged with the locking hole of the lever can be prevented. That is, when the interlock switch is connected, the lever always becomes locked, so that a stable connection state of the power supply circuit can be maintained.

Advantageous Effects of Invention

According to the switching apparatus of the invention, an operation of disconnecting the power supply circuit is facilitated. Also, the switching apparatus can be miniaturized and further occurrence of sparks at the time of disconnection and connection can be prevented. Further, a configuration of the switching apparatus is simplified, so that cost can be reduced.

DESCRIPTION OF EMBODIMENTS

A switching apparatus according to one embodiment of the invention will hereinafter be described in detail with reference to FIGS. 1 to 4.

A switching apparatus 1 of the present embodiment is mounted in a vehicle such as an electric vehicle or a hybrid car (not shown) for disconnecting a power supply circuit for making connection between a load of a motor, etc. for driving the vehicle and a DC power source such as a battery or a fuel cell for supplying electric power to the load. It will concretely be described as an example attached to a battery case. However, as long as a current flowing through the power supply circuit is interrupted, it is not limited to the case mounted in the vehicle and also, an attachment position of the switching apparatus 1 is not limited to the battery case.

Figure 1:
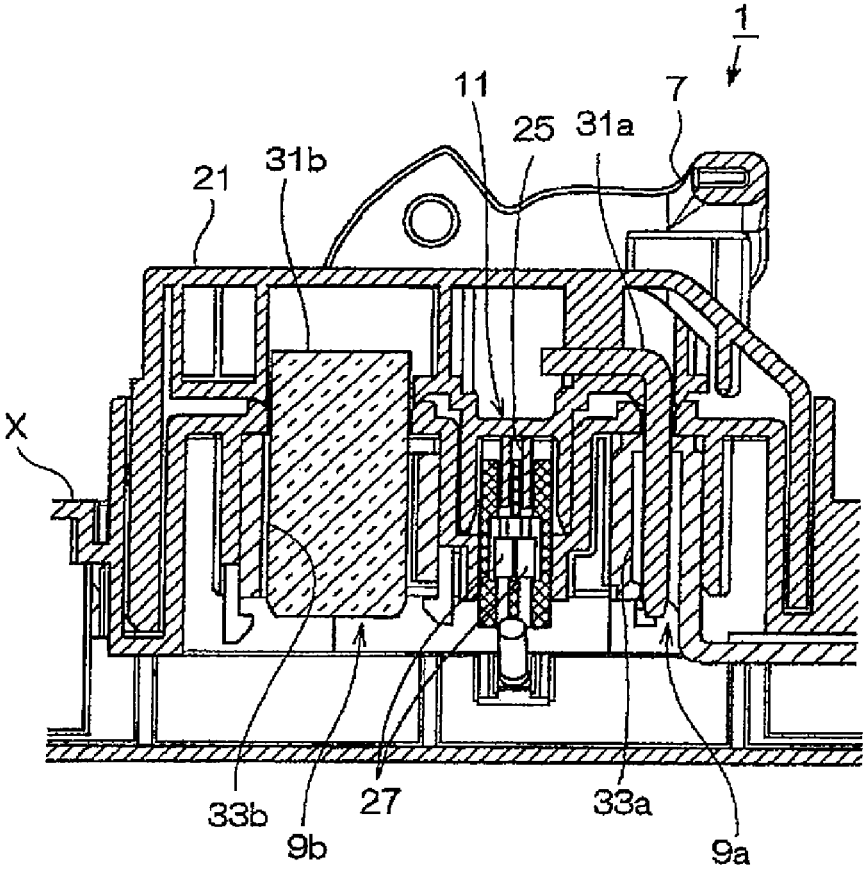
FIG. 1 is a sectional side view of a switching apparatus according to an embodiment of the invention and shows a state of locking a lever and connecting a power supply circuit.
Figure 2:
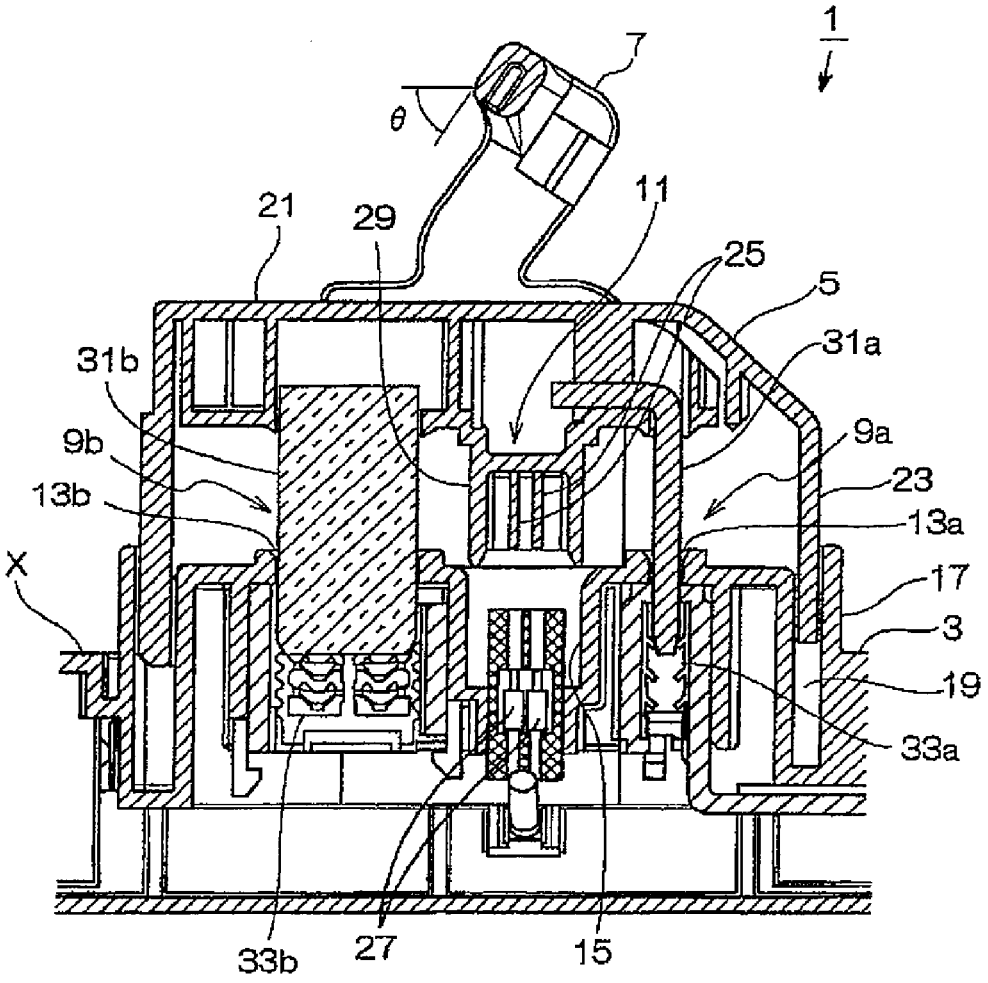
FIG. 2 is a sectional side view of the switching apparatus according to the embodiment of the invention and shows a state of rotating the lever to a maximum rotation angle and disconnecting the power supply circuit.

FIG. 1 shows a sectional side view of a switching apparatus in a state of connecting a power supply circuit, and FIG. 2 shows a sectional side view of the switching apparatus in a state of disconnecting the power supply circuit. As shown in FIGS. 1 and 2, the switching apparatus 1 includes a base 3 attached to a battery case etc., a housing 5 fitted into the base 3, a lever 7 for sliding the housing 5 with respect to the base 3, and main switches 9*a*, 9*b* and an interlock switch 11 which are arranged inside the housing 5.

Each of the main switches 9*a*, 9*b* and the interlock switch 11 includes a fixed terminal and a movable terminal. A female terminal is used in the fixed terminal and a male terminal is used in the movable terminal. The main switches 9*a*, 9*b* are switches for mechanically opening and closing the power supply circuit. The interlock switch 11 has, for example, a function of outputting a disconnection signal of the power supply circuit to an external disconnecting unit (not shown) for opening and closing the power supply circuit through a signal output unit (not shown). The disconnecting unit is connected to the power supply circuit, and has a function of inputting an electrical signal outputted from the signal output unit and opening and closing the power supply circuit in response to the electrical signal. Electromagnetic switchgear such as a well-known relay is used as the disconnecting unit. Consequently, electric power from a DC power source is supplied to a load via the main switches 9*a*, 9*b* and the disconnecting unit connected to the power supply circuit. In other words, the interlock switch 11 mechanically opens and closes the power supply circuit.

The base 3 is attached to the battery case etc., and includes two opening holes 13*a*, 13*b*. The opening holes 13*a*, 13*b* are formed inside a tubular protrusion projecting from a reference plane X of the base 3 upward (the housing side). Also, in the base 3, a circular groove 15 having a bottom surface lower than the reference plane X is formed in a position located between the two opening holes 13*a*, 13*b*, and a through hole is formed in the bottom surface of the circular groove 15. Also, in the base 3, an annular peripheral wall 17 is erected from the reference plane X and an annular groove 19 is formed inside the peripheral wall 17.

The housing 5 has an end face 21 and a wall 23 annularly erected from a peripheral edge of the end face 21. The housing 5 is formed in a tubular container with one end side of the wall 23 opened. The end face 21 of the housing 5 is formed in a shape in which one ends of a pair of parallel straight lines are joined by a straight line and the other ends are joined by a circular arc, and an edge of the side opposed to the circular arc is formed in an inclined surface chamfered. The housing 5 slides in a depth direction of the annular groove 19 in a state of inserting the wall 23 into the annular groove 19 of the base 3.

The interlock switch 11 includes two short-circuited male terminals 25 and two female terminals 27 into which the male terminals 25 are inserted. The male terminals 25 are fixed inside a tubular protrusion 29 projecting from the end face 21 of the housing 5 to the opening side, and the female terminals 27 are fixed inside the circular groove 15 of the base 3. The female terminals 27 are connected to the signal output unit, and in the case of being released from a state of respectively inserting the two male terminals 25 into the female terminals 27, that is, in the case of disconnecting the interlock switch 11, the signal output unit that has detected it outputs a signal for disconnecting the power supply circuit to the disconnecting unit and the disconnecting unit that has received the signal opens the power supply circuit. Moreover, in the case of inserting the male terminals 25 into the female terminals 27 to make connection from a state of opening the male terminals 25 and the female terminals 27, that is, in the case of connecting the interlock switch 11, the signal output unit that has detected it outputs a signal for closing the power supply circuit to the disconnecting unit and thereby the disconnecting unit closes the power supply circuit.

The main switches 9*a*, 9*b* include two short-circuited plate-shaped male terminals 31*a*, 31*b* and two female terminals 33*a*, 33*b* into which the male terminals 31*a*, 31*b* are inserted. The male terminals 31*a*, 31*b* are fixed in positions of both sides of the protrusion 29 of the housing 5, and the female terminals 33*a*, 33*b* are respectively fixed inside the opening holes 13*a*, 13*b* of the base 3. The male terminals 31*a*, 31*b* are respectively formed in a flat plate shape and are arranged so as to form a T-shape mutually when viewed from the opening side of the housing 5. In other words, the male terminals 31*a*, 31*b* are arranged substantially perpendicularly to each other. Further, the male terminals 31*a*, 31*b* are separated away from each other. In the female terminals 33*a*, 33*b*, one side is connected to the battery side of the power supply circuit and the other side is connected to the load side of the power supply circuit and by respectively inserting the short-circuited male terminals 31*a*, 31*b* into the female terminals 33*a*, 33*b*, the main switches 9*a*, 9*b* become connected and the power supply circuit becomes closed. In addition, the male terminals 31*a*, 31*b* have the same length. Thus, the male terminals 31, 31*b* respectively extend toward the female terminals 33*a*, 33*b* and are respectively inserted into the female terminals 33*a*, 33*b* at the same timing.

Here, in comparison between the male terminals of the main switches 9*a*, 9*b* and the interlock switch 11 fixed to the housing 5, the male terminals 31*a*, 31*b* of the main switches 9*a*, 9*b* extend longer than the male terminals 25 of the interlock switch 11 toward the side of the base 3. On the other hand, in comparison between the female terminals of the main switches 9*a*, 9*b* and the interlock switch 11 fixed to the base 3, the female terminals 33*a*, 33*b* of the main switches 9*a*, 9*b* are arranged in positions nearer to the housing 5 than the female terminals 27 of the interlock switch 11. In other words, when the housing 5 moves in a direction away from the base 3 in a state of respectively inserting the male terminals into the female terminals of the main switches 9*a*, 9*b* and the interlock switch 11, timing at which the male terminals 25 of the interlock switch 11 separate from the female terminals 27 is earlier than timing at which the male terminals 31*a*, 31*b* of the main switches 9*a*, 9*b* separate from the female terminals 33*a*, 33*b*.

Figure 3:
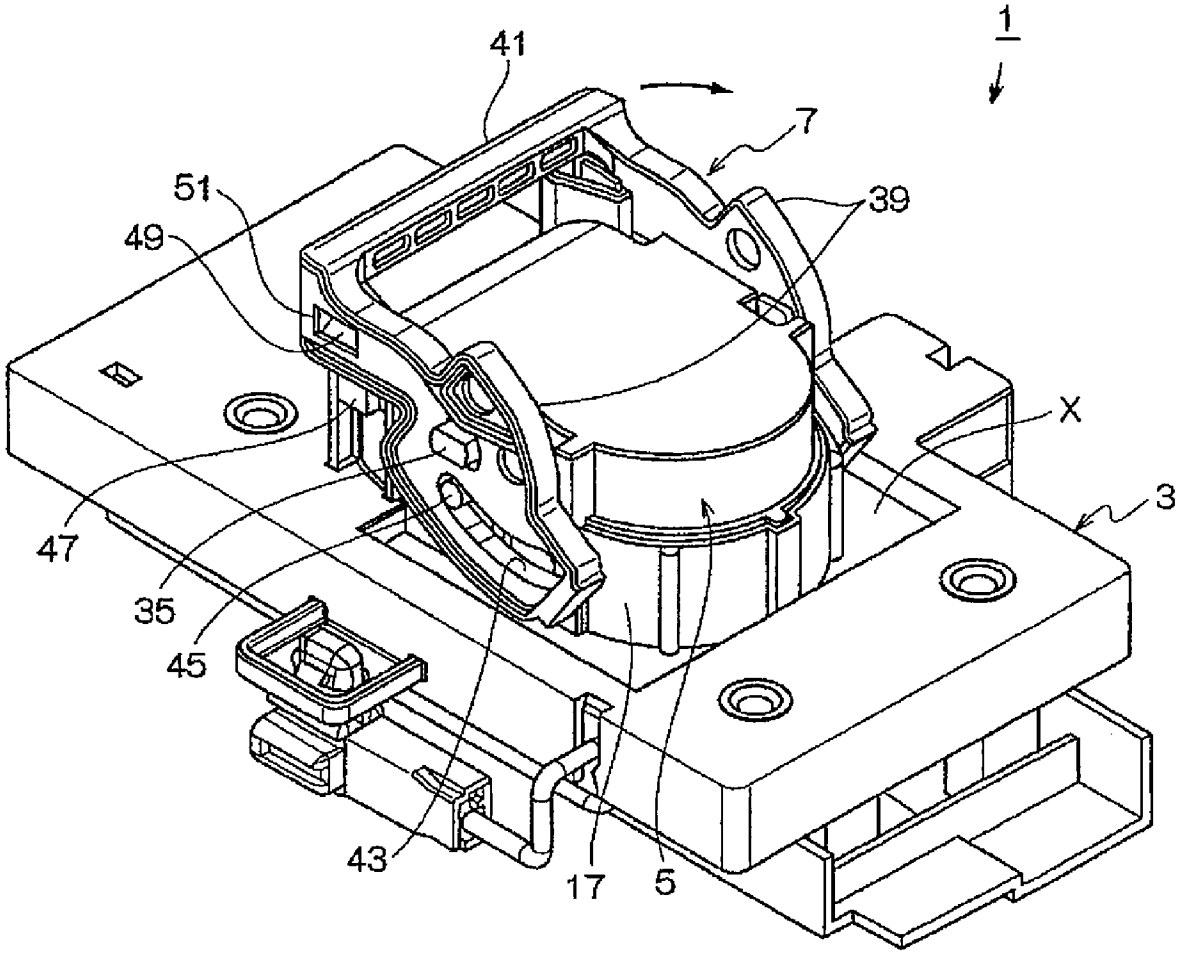
FIG. 3 is a perspective view corresponding to FIG. 1.

On the other hand, as shown in FIG. 3, support pins 35 are formed on side surfaces of the wall 23 of the housing 5 and the support pins 35 are fitted into locking holes 37 formed in the lever 7 and thereby, the lever 7 is rotatably supported in the housing 5. The lever 7 includes two support plates 39 in which the locking holes 37 are respectively formed, and a joint 41 for joining the two support plates 39, and the housing 5 is arranged in a state of being located between the insides of the two support plates 39.

Figure 4:
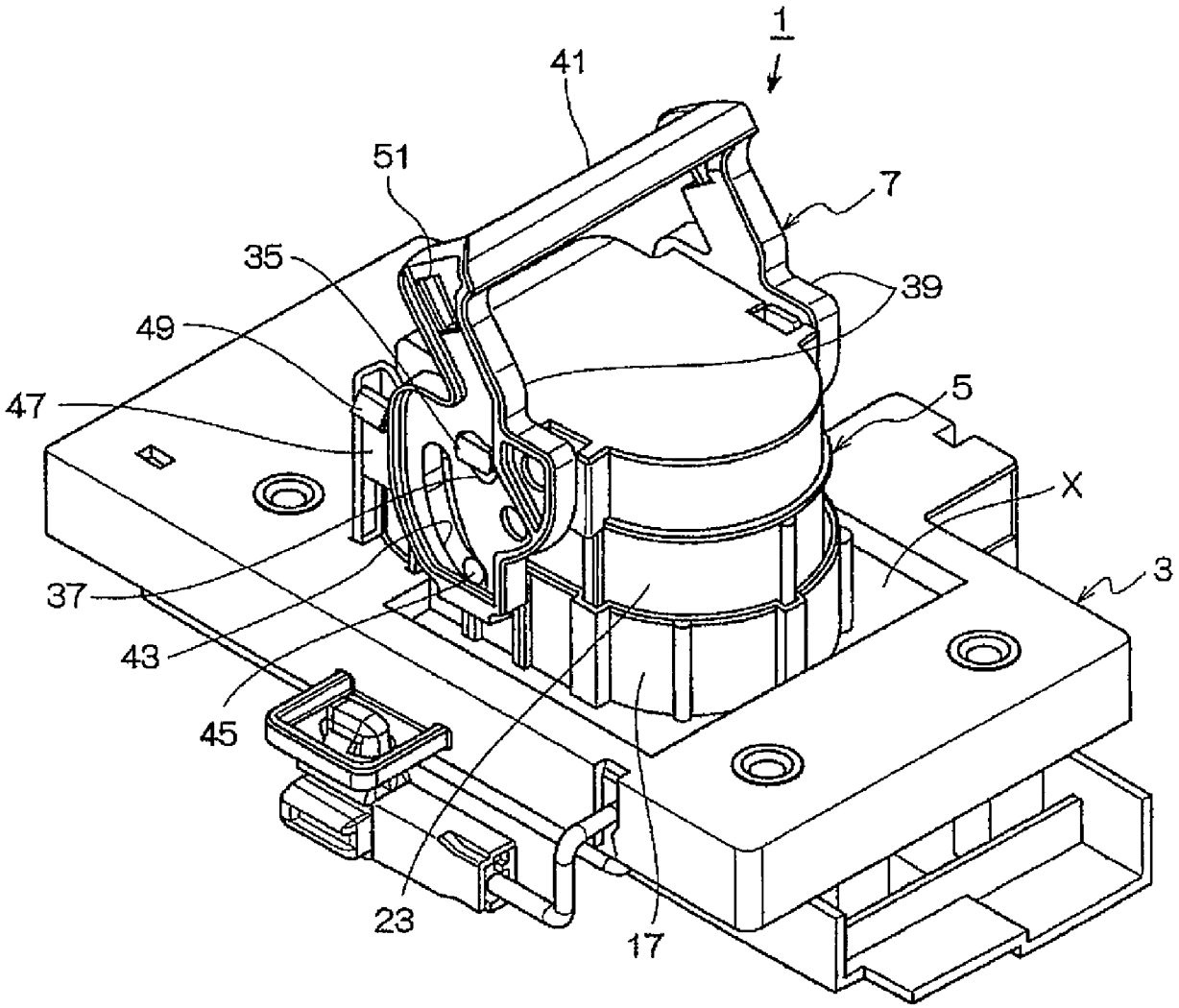
FIG. 4 is a perspective view corresponding to FIG. 2.

A circular arc-shaped cam hale 43 as a cam mechanism is formed in the lever 7, and a cam pin 45 fitted into the cam hole 43 is projected and formed on a side surface of the peripheral wall 17 of the base 3. Therefore, as shown in FIG. 3, by rotating the lever 7 in a direction (an arrow direction) of raising the lever 7 in a state of fitting the cam pins 45 into the cam holes 43, the cam pins 45 relatively move along the cam holes 43 and the housing 5 can be moved away from the base 3 along the annular groove 19 of the base 3. FIG. 4 shows a state of fully raising the lever 7.

Also, the base 3 is provided with two support members 47 extending in substantially parallel with a sliding direction of the housing 5, and locking protrusions 49 projecting in a direction substantially orthogonal to a rotating direction of the lever 7 are formed on head sides of the support members 47. The locking protrusions 49 are engaged with lock holes 51 respectively formed in the support plates 39 of the lever 7 when the lever 7 is rotated and pushed down as shown in FIG. 3. When the locking protrusions 49 are engaged with the lock holes 51, the lever 7 is locked to regulate the rotation of the lever 7. In this state, for example, the support members 47 are deformed with the fingers in a direction in which the locking protrusions 49 are disengaged from the lock holes 51 and thereby, the lever 7 is unlocked from the locked state.

Next, action of the switching apparatus 1 as configured above will be described. In a normal use state, the wall 23 of the housing 5 is fitted in a state of inserting the wall 23 into the annular groove 19 of the base 3 and the lever 7 becomes locked by the lock mechanism including the locking protrusions 49 as shown in FIG. 3. In the embodiment, a rotating angle of the lever in a state of locking the lever 7 by the lock mechanism is set at 0°. In this state, the housing 5 is nearest to the base 3, so that as shown in FIG. 1, the male terminals of the main switches 9*a*, 9*b* and the interlock switch 11 are inserted into the female terminals and all the switches become connected, that is, the power supply circuit becomes closed.

When maintenance work or the like is to be done in this state, in order to disconnect the power supply circuit, the lever 7 is unlocked and the lever 7 is rotated in a direction of raising the lever 7. Consequently, the housing 5 is lifted in a direction away from the base 3. As shown in FIG. 2, at a point in time of rotating the lever 7 to a maximum rotation angle θ (for example, 55°) determined by a cam mechanism, the male terminals 25 are detached from the female terminals 27 and the interlock switch 11 becomes disconnected, but in the main switches 9*a*, 9*b*, the male terminals 31*a*, 31*b* remain inserted into the female terminals 33*a*, 33*b* and the connected state is maintained. In other words, while the lever 7 is rotated from 0° to the maximum rotation angle θ, the connected state of the main switches 9*a*, 9*b* is maintained but the interlock switch 11 is disconnected, so that the power supply circuit becomes opened.

When the lever 7 is rotated to the maximum rotation angle θ and becomes raised thus, the joint 41 is subsequently gripped and the lever 7 is pulled up. By pulling up the lever 7, the cam pins 45 are removed from the cam holes 43 of the lever 7, and the housing 5 attached with the lever 7 is detached from the base 3. Consequently, the main switches 9*a*, 9*b* are disconnected but the interlock switch 11 has already been disconnected and the power supply circuit has become opened, so that sparks do not occur between the terminals of the main switches 9*a*, 9*b* at a point in time of disconnecting the main switches 9*a*, 9*b*. Also, both the switches are disconnected and the power supply circuit becomes opened and the housing 5 is completely detached from the base 3, so that a situation in which both the switches are again closed due to incorrect operation etc. and the power supply circuit is closed does not occur and an electric shock etc. in the maintenance work or the like can be prevented surely.

Next, when the maintenance work or the like is finished and the power supply circuit is to be closed, the housing 5 attached with the lever 7 is brought near to the base 3 and the wall 23 of the housing 5 is inserted into the annular groove 19 of the base 3 and also the male terminals 31*a*, 31*b* of the main switches 9*a*, 9*b* extending from the side of the housing 5 are respectively inserted into the female terminals 33*a*, 33*b* of the side of the base 3. Then, the lever 7 is rotated in a direction of laying the lever 7 in a state of respectively fitting the cam pins 45 into the two cam holes 43 of the lever 7. Consequently, the cam pins 45 relatively move along the cam holes 43 and the housing 5 moves in a direction near to the base 3. When the lever 7 is further rotated, the locking protrusions 49 abut on the support plates 39 of the lever 7, so that the lever 7 is firmly pushed in a rotating direction in this state and thereby, the locking protrusions 49 are engaged with the lock holes 51 and the lever 7 becomes locked.

Here, at a point in time before the lever 7 is locked, that is, before the locking protrusions 49 are engaged with the lock holes 51 of the lever 7, the main switches 9*a*, 9*b* become connected and the interlock switch 11 is being disconnected. Further, at a point in time when the locking protrusions 49 are engaged with the lock holes 51, both the main switches 9*a*, 9*b* and the interlock switch 11 become connected. By setting timing of connections of both the switches thus, a situation in which in an unstable connection state before the lever 7 is locked, both the main switches 9*a*, 9*b* and the interlock switch 11 are connected and the power supply circuit becomes closed can be prevented, so that safety can be improved.

In the switching apparatus 1 of the embodiment, when the housing 5 detached from the base 3 is again attached to the base 3, the male terminals 25 of the interlock switch 11 are inserted into the female terminals 27 in a state of respectively inserting the male terminals 31*a*, 31*b* of the main switches 9*a*, 9*b* into the female terminals 33*a*, 33*b*, so that the male terminals 25 of the interlock switch 11 are inserted into the female terminals 27 in a state of being aligned with the female terminals 27 by the main switches 9*a*, 9*b*. In other words, the main switches 9*a*, 9*b* play a role as a guide of the interlock switch 11, and accuracy of a position between the male terminals 25 and the female terminals 27 of the interlock switch 11 improves, so that, for example, the male terminals 25 can be prevented from being obliquely inserted into the female terminals 27 and smooth fitting between the terminals can be implemented and also damage to the male terminals 25 and the female terminals 27 can be prevented.

In the embodiment, the main switches 9*a*, 9*b* are described as the example of providing two pairs of male terminals 31*a*, 31*b* and female terminals 33*a*, 33*b*, but are not limited to this example, and more main switches (male terminals shall be mutually short-circuited) may be provided. In this case, it is preferable to arrange the main switches in respectively different directions around the interlock switch 11. Consequently, positioning accuracy of the interlock switch 11 can be improved more.

In the switching apparatus 1 of the embodiment, both the male terminals of the main switches 9*a*, 9*b* and the interlock switch 11 include the male terminals which move integrally with the housing 5, so that the interlock switch 11 and the main switches 9*a*, 9*b* can be sequentially disconnected by moving the housing 5 in a direction away from the base 3. In other words, an operation of disconnecting the power supply circuit includes a first operation of rotating the lever 7 to the maximum rotation angle and disconnecting the interlock switch 11 and a second operation of disconnecting the main switches 9*a*, 9*b* by pulling up the lever 7 and detaching the housing 5 from the base 3, but both of these operations are operations of separating the housing 5 from the base 3 and can be performed continuously, so that the power supply circuit can be disconnected by a simple operation of only pulling up the lever 7 after the lever 7 is rotated.

Also, in the switching apparatus 1 of the embodiment, when a stroke amount of movement of the housing 5 at the time of rotating the lever 7 from the rotating angle of 0° to the maximum rotation angle θ is set at L1 and stroke amounts of movement of the male terminals from a connection state (a state of the lever 7 at the rotating angle of 0°) of respectively inserting the male terminals into the female terminals to a state of separating both the terminals and opening the switches in the interlock switch 11 and the main switches 9*a*, 9*b* are respectively set at L2 and L3, the male terminals and the female terminals of the interlock switch 11 and the main switches 9*a*, 9*b* are respectively arranged in proper positions so as to satisfy L3>L1>L2. As a result, at the time of operation of disconnecting the power supply circuit, the interlock switch 11 is always disconnected ahead of the main switches 9*a*, 9*b*, so that sparks do not occur between the terminals at a point in time of disconnecting the main switches 9*a*, 9*b*. As a result, for example, a signal system is not affected adversely and also degradation etc. in the terminal can be reduced.

Also, in the switching apparatus 1 of the embodiment, the interlock switch 11 and the main switches 9*a*, 9*b* are arranged inside the housing 5, so that effects of waterproof and dustproof properties can be obtained and also the whole apparatus can be constructed compactly. As a result, the switching apparatus 1 can be arranged in smaller space and flexibility of design can be improved.

Also, in the switching apparatus 1 of the embodiment, at a point in time of rotating the lever 7 to the maximum rotation angle θ, the main switches 9*a*, 9*b* remain connected but the interlock switch 11 has already been disconnected, so that even when the housing 5 is thereafter separated from the base 3, an order in which the interlock switch 11 and the main switches 9*a*, 9*b* are disconnected is ensured. Therefore, in the case of being formed so as to disconnect only the interlock switch 11 at a point in time of rotating the lever 7 to the maximum rotation angle θ, the amount (stroke amount) of movement of the housing 5 by a rotating operation of the lever 7 can be set at a minimum, with the result that a dimension of a height direction of the whole switching apparatus 1 (a movement direction of the housing 5) can be decreased. In addition, it can be constructed so as to disconnect the interlock switch 11 followed by the main switches 9*a*, 9*b* at a point in time of rotating the lever 7 to the maximum rotation angle θ, but in that case, the dimension of the height direction of the switching apparatus 1 increases, so that it is necessary to consider a relation to storage space.

Also, in the embodiment, the example in which the lever 7 is rotatably supported in the housing 5 and the cam mechanism is constructed by engagement between the cam holes 43 and the cam pins 45 formed in the base 3 is described, but as long as a configuration in which the housing 5 can be slid along the annular groove 19 of the base 3 by rotating the lever 7 is used, it may be formed so that the lever 7 is rotatably supported in the base 3 and the cam mechanism is constructed between the housing 5 and the lever 7.

This application is based on and claims the benefit of Japanese patent application No. 2010-220851 filed on Sep. 30, 2010, the contents of which are incorporated herein by reference.

INDUSTRIAL APPLICABILITY

According to the invention, since the mechanical connection and electrical connection to the power supply circuit are controlled by the lever by one sequence of the operation, it can provide a switching apparatus for capable of facilitating a disconnecting operation, achieving miniaturization and preventing occurrence of sparks at the time of disconnection and connection.

The invention claimed is:

1. A switching apparatus, comprising:

a main switch for mechanically disconnecting a power supply circuit;

an interlock switch which outputs a disconnection signal for electrically disconnecting the power supply circuit; a base on which an annular groove is formed; a housing having a wall to be inserted into the annular groove of the base; and a lever which is rotatably supported by one of the base and the housing and also is engaged with an engaging section formed in the other of the base and the housing, the lever causing the wall of the housing to be slid in a depth direction of the annular groove in accordance with a rotation of the lever, wherein each of the main switch and the interlock switch includes a fixed terminal fixed to the base and a movable terminal fixed to the housing, the interlock switch is configured to be disconnected ahead of the main switch by separating the movable terminal of the interlock switch away from the fixed terminal of the interlock switch when the lever is rotated to cause the housing to be slid in a direction away from the base and the fixed and movable terminals of the interlock switch are arranged between the fixed and movable terminals of the main switch.

2. The switching apparatus according to claim 1, wherein the fixed terminals of the main switch and the interlock switch include female terminals, the movable terminals of the main switch and the interlock switch include male terminals to be inserted into the respective female terminals, and when the lever is rotated to cause the housing slid in the direction away from the base and reaches a maximum rotation angle of the lever, a part of the male terminal of the main switch is still being inserted in the opposing female terminal.

3. The switching apparatus according to claim 1, wherein the movable terminal of the main switch includes two male terminals each formed in a flat plate, the fixed terminal of the main switch includes two female terminals to be inserted into the two female terminals, respectively, and the two male terminals are arranged substantially perpendicularly to each other, and separated away from each other.

4. The switching apparatus according to claim 3, wherein the two male terminals are separated away from each other.

5. The switching apparatus according to claim 1, wherein the lever includes a lock hole, the base includes a protrusion to be engaged with the lock hole to thereby regulate the rotation of the lever, and in accordance with the rotation of the lever, the interlock switch is connected when the protrusion is engaged with the lock hole, whereas the interlock switch is disconnected when the protrusion is disengaged from the lock hole.

* * * * *